US008397799B2

(12) United States Patent
Blecker

(10) Patent No.: US 8,397,799 B2
(45) Date of Patent: Mar. 19, 2013

(54) AUTOMATIC SWITCHING TWO PIPE HYDRONIC SYSTEM

(76) Inventor: Joseph G. Blecker, Laguna Niguel, CA (US)

( * ) Notice: Subject to any disclaimer, the term of this patent is extended or adjusted under 35 U.S.C. 154(b) by 0 days.

(21) Appl. No.: 13/431,410

(22) Filed: Mar. 27, 2012

(65) Prior Publication Data

US 2012/0181009 A1 Jul. 19, 2012

Related U.S. Application Data

(62) Division of application No. 11/743,069, filed on May 1, 2007, now Pat. No. 8,141,623.

(51) Int. Cl.
*F25B 29/00* (2006.01)

(52) U.S. Cl. ..... 165/221; 165/48.1; 165/50; 62/185; 62/238.6; 62/310; 62/434; 62/435; 237/8 R; 237/8 A; 237/19; 236/1 C; 236/1 B

(58) Field of Classification Search ..... 165/50, 165/219, 220, 221, 218, 48.1; 62/185, 238.6, 62/238.7, 305, 310, 434, 435, 201, 175; 237/2 R, 237/8 R, 8 A, 19; 236/1 C, 1 B
See application file for complete search history.

(56) References Cited

U.S. PATENT DOCUMENTS

| | | | | | |
|---|---|---|---|---|---|
| 2,363,945 | A | * | 11/1944 | Carrier | 165/214 |
| 2,557,035 | A | * | 6/1951 | Lichty | 165/259 |
| 2,797,068 | A | * | 6/1957 | McFarlan | 165/207 |
| 3,127,929 | A | * | 4/1964 | Ringquist | 165/221 |
| 3,170,508 | A | * | 2/1965 | Avery | 165/221 |
| 3,176,759 | A | * | 4/1965 | Windham | 165/220 |
| 3,241,602 | A | * | 3/1966 | Andreassen | 165/221 |
| 3,256,929 | A | * | 6/1966 | Carlson | 165/221 |
| 3,303,873 | A | * | 2/1967 | Ringqulst et al. | 165/221 |
| 3,378,062 | A | * | 4/1968 | Ringquist et al. | 165/221 |
| 3,406,744 | A | * | 10/1968 | Scheibler | 165/221 |
| 3,411,538 | A | * | 11/1968 | Gruner et al. | 165/221 |
| 3,685,574 | A | * | 8/1972 | Worms | 165/221 |
| 3,693,704 | A | * | 9/1972 | Newton | 165/221 |
| 4,457,358 | A | * | 7/1984 | Kriege et al. | 165/50 |
| 7,028,768 | B2 | * | 4/2006 | Aler et al. | 165/219 |
| 8,141,623 | B2 | * | 3/2012 | Blecker | 165/48.1 |

* cited by examiner

*Primary Examiner* — John Ford
(74) *Attorney, Agent, or Firm* — Aidenbaum Schloff and Bloom PLLC; Jay Schloff

(57) ABSTRACT

A system for simultaneously heating and cooling a first portion and a second portion of a space utilizes a plurality of boilers, chillers, heat exchangers, condenser pumps and closed loop pumps by using a plurality of sensors indicating the temperatures inside and outside the space and a controlling module controlling the operation of the system. The present disclosure can be easily achieved by making minor configurational modifications to existing systems, thereby increasing system versatility.

12 Claims, 6 Drawing Sheets

AUTOMATIC SWITCHING TWO PIPE HYDRONIC SYSTEM

CROSS REFERENCE TO RELATED APPLICATIONS

The present application is a divisional application of U.S. patent application Ser. No. 11/743,069, filed on May 1, 2007 now U.S. Pat. No. 8,141,623, the disclosure of which is incorporated herein by reference.

FIELD OF THE DISCLOSURE

The present disclosure relates to air-conditioning systems and more particularly relates to an automatic switching two pipe hydronic system for conditioning a space.

BACKGROUND OF DISCLOSURE

Space heating is a component of heating, ventilation, and air conditioning (HVAC) and is a predominant mode of conditioning space. Depending on the local climate, space heating is in operation up to and beyond seven months out of the year. During the time of such operation, there will be numerous occasions when cooling of the space will be needed to prevent discomfort and lost productivity of inhabitants of such space. Thus, the adjustability of HVAC systems is desirable. Space heating has traditionally been accomplished by two-pipe systems that incorporate a hot water boiler.

One approach to improve the adjustability of HVAC systems is shown by U.S. Pat. No. 4,360,152, which discloses an auxiliary heating system for reducing fuel consumption of a conventional forced-air heating system. A boiler tank substantially filled with water is connected by hot and cold water lines to a heat exchanger disposed within the cold air duct of the forced-air heating system. A firebox which extends into the boiler tank is adapted to receive combustible material such as wood for heating the water in the tank. A pump directs hot water from the tank through the hot water line to the heat exchanger whereby cool air moving through the cold air duct is preheated as it passes through the heat exchanger. Heating tubes in communication with water in the boiler tank may extend through the firebox for supporting logs therein. Additional heating tubes may extend through a flue directed upwardly from the firebox through the boiler tank. A disadvantage to the '152 disclosure is that requires the installation of an additional component to the existing HVAC system.

Another approach directed at the adjustability of HVAC systems is shown in U.S. Pat. No. 6,769,482, which discloses a HVAC device that includes both heating and cooling operating modes. The '482 disclosure provides an interface for selecting the operating parameters of the device. The interface allows the input of a set point temperature at which the HVAC device conditions the ambient temperature of a space. A mode switch-over algorithm uses the set point temperature, the sensed temperature from the conditioned space, and prestored threshold values that depend on the device's operating capacities, to determine when to change the device between heating and cooling modes. Within each of the respective modes, a heating or cooling algorithm controls the engaging and disengaging of the heating and cooling elements of the device to maintain the temperature of the conditioned space within a desired comfort zone. The '482 patent does not address the diverse and localized needs within large spaces, such as where a large space will require cooling in one area and heating in another area.

The use of variable speed pumps for control of HVAC systems has been adopted in U.S. Pat. No. 5,095,715, wherein an integrated heat pump and hot water system provides heating or cooling of a comfort zone, as required, and also provides water heating. As a power management feature, the speed of a variable speed compressor is reduced to a predetermined fraction of its normal operating speed, in response to a demand limit signal provided from the electric power utility during times of peak electrical load. A reference compressor speed is computed based on the current compressor speed, indoor temperature, outdoor temperature, and zero-load temperature difference. If the system is between operating cycles when the demand limit signal is received, a stored speed is used which corresponds to the compressor speed at a predetermined outdoor-indoor temperature difference. The '715 disclosure fails to address the diverse and localized needs within large spaces, such as where a large space will require cooling in one area and heating in another area.

Notwithstanding these efforts, the prior art fails to improve the functionality and adjustability of HVAC systems to meet today's needs of energy conservation and quick changeover from heating to cooling in a space and of being able to provide heating and cooling at the same by the same system.

Accordingly, there is a need in the art for an improved HVAC system that can use water in an efficient manner, for instance from both the cooling side and boiler side of a space heating configuration. Because of the higher costs of the construction of new buildings, there is also a need for an improved HVAC system that will be able to be retrofitted to existing spaces at a cost that is less than the installation of an entirely new HVAC system. There is also a need for an adjustable system that offers simultaneous cooling and heating, depending on the need of the particular subunit of the space in which the HVAC operates.

SUMMARY OF THE DISCLOSURE

In view of the foregoing disadvantages inherent in the prior art, the general purpose of the present disclosure is to provide a system for conditioning a space and to include all the advantages of the prior art, and to overcome the drawbacks of the prior art.

In an embodiment, the present disclosure provides a system for simultaneously heating and cooling a first portion and a second portion of a space. The system comprises: a first flow path; a second flow path; a plurality of closed loop pumps; a plurality of boilers; a plurality of heat exchangers; a plurality of chillers; a plurality of condenser pumps; a plurality of boiler flow control valves; a plurality of chiller flow control valves; a plurality of heat exchanger flow control valves; a plurality of sensors; and a controlling module. The first flow path is disposed towards the first portion and the first flow path is having a first supply line and a first return line. The second flow path is disposed towards the second portion and the second flow path is having a second supply line and a second return line. The supply line is configured to supply a conditioned fluid to the space and the return line is configured to return utilized conditioned fluid from the space. The closed loop pump is capable of circulating the conditioned fluid and the utilized conditioned fluid between the supply and return lines of the first flow path and the second flow path.

The boilers are disposed between the first portion and the second portion and the boilers are capable of providing conditioned fluid to the first supply line and the second supply line. The heat exchangers are disposed between the first portion and the second portion and the heat exchangers are capable of receiving utilized conditioned fluid from the first and the second return line, for reducing the temperature of the utilized conditioned fluid in the first return line and the second return line to be supplied as the conditioned fluid to the first supply line and the second supply line by transferring heat of the utilized conditioned fluid to a cooling tower fluid. The chillers are disposed between the first portion and the second portion. The chillers are capable of receiving utilized conditioned fluid from the first return line and the second return line, for reducing the temperature of the utilized conditioned fluid in the first return line and the second return line to be supplied as the conditioned fluid to the first supply line and the second supply line by transferring heat of the utilized conditioned fluid to the cooling tower fluid.

The condenser pumps are disposed between the first flow path and the second flow path. The condenser pumps are capable of circulating a cooling tower fluid between the cooling tower and the plurality of heat exchangers and the plurality of chillers. The boiler flow control valves are coupled to the plurality of boilers. The boiler flow control valves are capable of controlling the flow of utilized conditioned fluid to the boilers from the first and second return lines and conditioned fluid from the boiler to the first and second supply lines. The chiller flow control valves are coupled to the plurality of chillers and are capable of controlling the flow of utilized conditioned fluid to the chillers from the first and second return lines and conditioned fluid from the chillers to the first and second supply lines. The heat exchanger flow control valves are coupled to the plurality of heat exchangers and are capable of controlling the flow of utilized conditioned fluid to the heat exchangers from the first and second return lines and conditioned fluid from the heat exchangers to the first and second supply lines.

The sensors are configured for sensing an outside space temperature, a temperature of the first portion and the second portion inside the space, and temperatures of the conditioned fluid and the utilized conditioned fluid in the first flow path and the second flow path. The controlling module is configured to acquire temperatures from the plurality of sensors and is capable of controlling the flow of conditioned fluid and utilized conditioned fluid through the boiler, chiller and heat exchanger flow control valves. The controlling module is configured to operate the boiler, the chiller and the heat exchanger flow control valves in a manner such that at least one boiler from the plurality of boilers and at least one chiller from the plurality of chillers or at least one heat exchanger from the plurality of heat exchangers are capable of heating or cooling the first portion and the second portion simultaneously.

These together with other aspects of the present disclosure, along with the various features of novelty that characterize the disclosure, are pointed out with particularity in the claims annexed hereto and form a part of this disclosure. For a better understanding of the disclosure, its operating advantages, and the specific objects attained by its uses, reference should be made to the accompanying drawings and descriptive matter in which there are illustrated exemplary embodiments of the present disclosure.

BRIEF DESCRIPTION OF THE DRAWINGS

The advantages and features of the present disclosure will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DISCLOSURE

The exemplary embodiments described herein detail for illustrative purposes are subject to many variations in structure and design. It should be emphasized, however, that the present disclosure is not limited to an automatic switching two pipe hydronic system as shown and described. It is understood that various omissions, substitutions, and equivalents are contemplated as circumstances may suggest or render expedient, but it is intended to cover the application or implementation without departing from the spirit or scope of the claims of the present disclosure. The terms “a”, “an”, “first”, and “second”, herein do not denote a limitation of quantity, but rather denote the presence of at least one of the referenced item.

It should be noted that the various temperature ranges and corresponding operational set points discussed herein are for illustrative purposes only and that the particular set points and temperature ranges will depend on the particular geographic location and climate conditions of the space in which the present disclosure is put into use and on the settings chosen by the particular user.

The present disclosure provides an automatic switching two pipe hydronic system for conditioning a space. The automatic switching two pipe hydronic system of the present is applicable to commercial and residential buildings and is capable of simultaneously heating and cooling different portions of a building in an efficient manner. The present disclosure aims at saving fuel, energy and water, when there are lower load conditions that affect boilers, chillers, and cooling towers. The configurational modifications proposed by the present disclosure aim at increasing: occupant productivity and comfort, reduction in maintenance, future capital expense, prolonged major equipment life span, and improvement of the environment. Further, the present disclosure can be easily configured by making minor configurational amendments in existing system, thereby aiding the versatility of the present disclosure.

Referring to FIG. 1-6, an automatic switching two pipe hydronic system 1000 for conditioning a space is shown.

Figure 1:
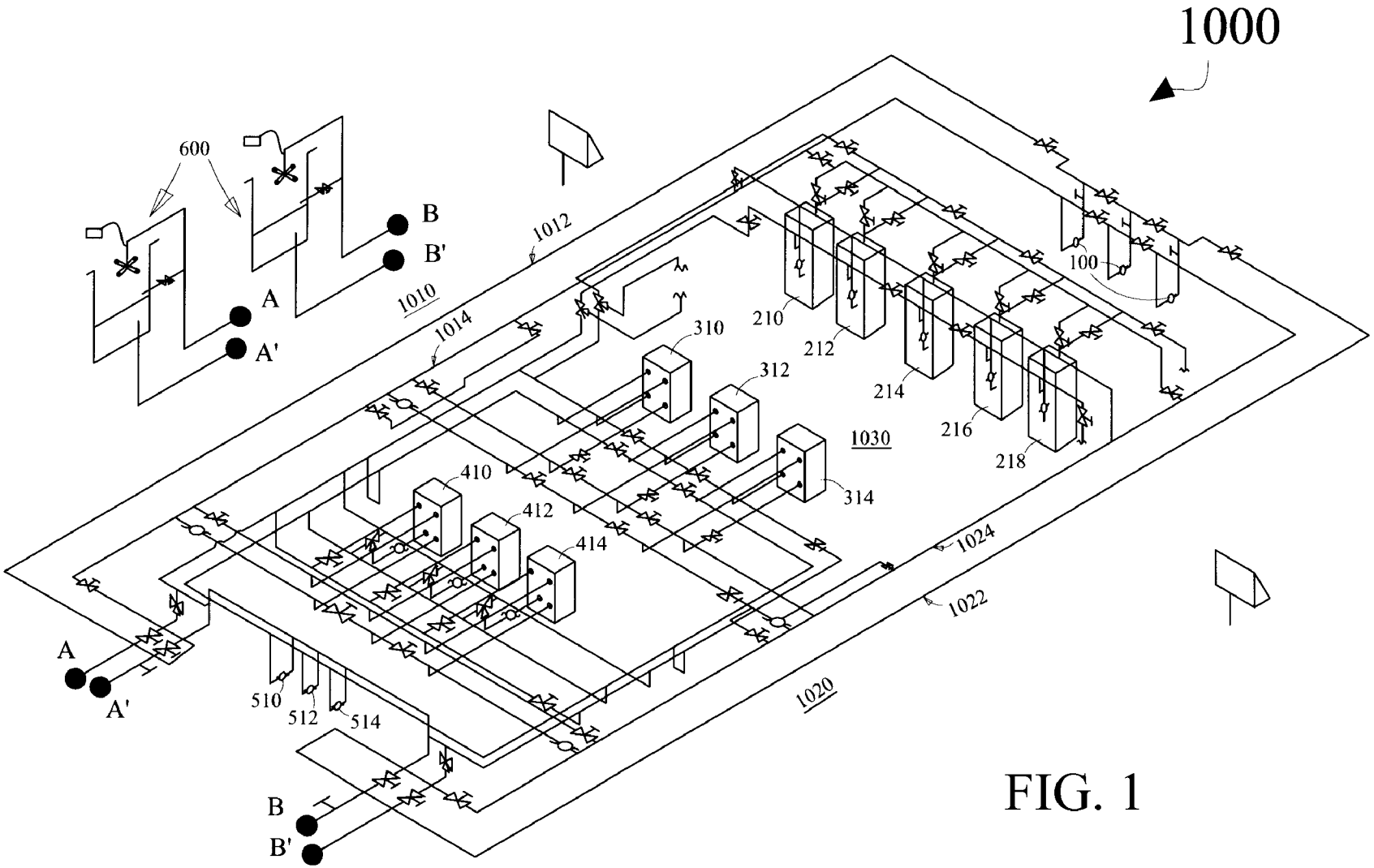
FIG. 1 is a schematic line diagram of an automatic switching two pipe hydronic system 1000 for simultaneously heating and cooling different portions of a space, according to an exemplary embodiment of the present disclosure.

In an embodiment, the present disclosure provides an automatic switching two pipe hydronic system for simultaneously heating and cooling different portions of a space. More specifically, now referring to FIG. 1, illustrated is an automatic switching two pipe hydronic system 1000 (herein after referred to as system 1000) for simultaneously heating and cooling a first portion 1010 and a second portion 1020 of a space 1030. As used herein, 'space' refers to a building space that needs to be air-conditioned depending upon the requirement on different portions of the building. In an exemplary situation, a scenario is considered wherein the system 1000 is configured to provide heating to a first portion 1010 (for example, a north side of a building not receiving proper sunlight in northern hemisphere winters) and the cooling to a second portion 1020 (for example, a south side of the building receiving proper sunlight in the northern hemisphere). The present disclosure is designed to be particularly effective with buildings having exposures such as East-West and North-South exposures. Other suitable exposures include, but are not limited to, West, North, North through North, East, North opposing East, East, South through Southwest, and South. Furthermore, other exposures may include North, East, East through East, Southeast opposing South, West, West to West-northwest. The disclosure is readily configurable to a building's particular solar exposure, depending on whether the building is situated in the northern or southern hemisphere. The architectural features of a building may be slightly modified or designed to enhance the adoption of the technology for increasing or decreasing solar exposure.

The system 1000 comprises a first flow path disposed towards the first portion 1010, the first flow path including a first supply line 1012 and a first return line 1014; a second flow path disposed towards the second portion 1020, the second flow path including a second supply line 1022 and a second return line 1024. Both the first flow path and the second flow path are capable of circulating a conditioned fluid for heating and cooling the space 1030 and receiving a utilized conditioned fluid from the space 1030 for re-conditioning the utilized conditioned fluid to the conditioned fluid. The system 1000 further comprises a plurality of closed loop pumps 100; a plurality of boilers 210, 212, 214, 216 and 218 disposed between the first flow path and the second flow path; a plurality of chillers 310, 312 and 314 disposed between the first flow path and the second flow path; a plurality of heat exchangers 410, 412 and 414 disposed between the first flow path and the second flow path; a plurality of condenser pumps 510, 512, and 514 disposed between the first flow path and the second flow path; a plurality of boiler flow control valves 250 coupled to the plurality of boilers 210, 212, 214, 216 and 218; a plurality of chiller flow control valves 350 coupled to the plurality of chillers 310, 312 and 314; a plurality of heart exchanger flow control valves 450 coupled to the plurality of heat exchangers 410, 412, 414; a plurality of sensors 700 for sensing an outside space temperature, a temperature of the first portion 1010 and the second portion 1020 within the space 1030 and temperatures of the conditioned fluid and utilized conditioned fluid in the first flow path and the second path; and a controlling module configured to acquire temperatures from the plurality of sensors 700 and capable of controlling the flow of conditioned fluid and utilized conditioned fluid through the boiler, chiller, and heat exchanger flow control valves 250, 350 and 450.

The supply lines 1012 and 1022 are configured to supply a conditioned fluid to the space 1030 and the return lines 1014 and 1024 are configured to return utilized conditioned fluid from the space 1030. The plurality of closed loop pumps are capable of circulating the conditioned fluid and the utilized conditioned fluid between the supply line 1012 and return line 1014 of the first flow path and between the supply line 1022 and return line 1024 of the second flow path. The plurality of boilers 210, 212, 214, 216 and 218 are capable of providing conditioned fluid to the first supply line 1012 and the second supply line 1022. The boilers 210, 212, 214, 216 and 218 generally have a dual function to perform, one being utilized for heating and the other for meeting the demand for domestic hot water supply. Very high efficiency boilers have small amounts of boiler water, operate at temperatures that vary from 70° F. to 180° F. and have stainless steel components for heat transfer, permitting direct contact with municipal water.

The heat exchangers 410, 412, and 414 are capable of receiving utilized conditioned fluid from the first return line 1014 and the second return line 1024, for reducing the temperature of the utilized conditioned fluid in the first return line 1014 and the second return line 1024 to be supplied as the conditioned fluid to the first supply line 1012 and the second supply line 1022 by transferring heat of the utilized conditioned fluid to a cooling tower fluid. The chillers 310, 312, and 314 are capable of receiving utilized conditioned fluid from the first return line 1014 and the second return line 1024, for reducing the temperature of the utilized conditioned fluid in the first return line 1014 and the second return line 1024 to be supplied as the conditioned fluid to the first supply line 1012 and the second supply line 1022 by transferring heat of the utilized conditioned fluid to the cooling tower fluid. The condenser pumps 510, 512, and 514 are capable of circulating the cooling tower fluid between a cooling tower 600 and the plurality of heat exchangers 410, 412, and 414 and the plurality of chillers 310, 312, and 314. The boiler flow control valves 250 are capable of controlling the flow of utilized conditioned fluid to the plurality of boilers 210, 212, 214, 216, and 218 from the first return line 1014 and the second return line 1024 and conditioned fluid from the plurality of boilers 210, 212, 214, 216, and 218 to the first supply line 1012 and the second supply line 1022. The plurality of chiller flow control valves 350 are capable of controlling the flow of utilized conditioned fluid to the chillers 310, 312, and 314 from the first return line 1014 and the second return line 1024 and conditioned fluid from the chillers 310, 312, and 314 to the first supply line 1012 and the second supply line 1022. The heat exchanger flow control valves 450 are capable of controlling the flow of utilized conditioned fluid to the heat exchangers 410, 412, and 414 from the first return line 1014 and the second return line 1024 and conditioned fluid from the heat exchangers 410, 412, and 414 to the first supply line 1012 and the second supply line 1022. The controlling module is configured to operate the boiler flow control valves 250, the chiller flow control valves 350 and the heat exchanger flow control valves 450 in a manner such that at least one boiler from the plurality of boilers 210, 212, 214, 216, and 218 and at least one chiller from the plurality of chillers 310, 312, and 3214 or at least one heat exchanger 410, 412, and 414 from the plurality of heat exchangers 410, 412, and 414 are capable of heating or cooling the first portion 1010 and the second portion 1020 simultaneously.

Figure 2:
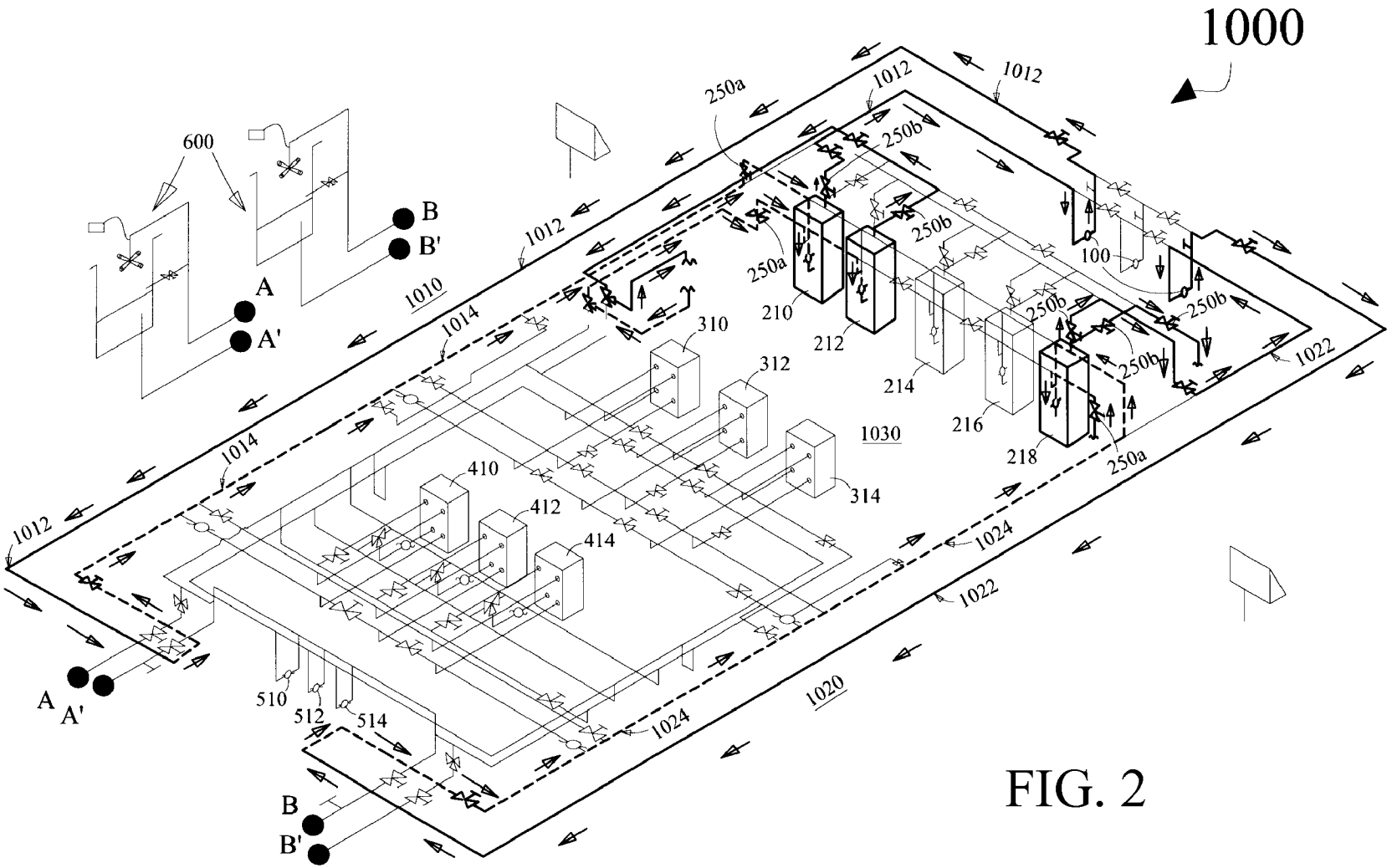
FIG. 2 is a schematic line diagram of the automatic switching two pipe hydronic system 1000, illustrating boilers 210 and 212 heating a first portion 1010 of a space 1030 and a boiler 218 heating a second portion 1020 of the space, according to another exemplary embodiment of the present disclosure.

Now, referring to FIG. 2, illustrated is a schematic line diagram of the system 1000, wherein at least one boiler from the plurality of boilers 210, 212, 214, 216, and 218 is individually heating a first portion 1010 of the space 1030 and providing domestic heat water and a second boiler from the plurality of boilers 210, 212, 214, 216, and 218 provides both heating and domestic heat water to the second portion 1020 of the space 1030. More particularly, for the first portion 1010, the boiler 210 receives the utilized conditioned fluid from the first return line 1014 for supplying conditioned fluid to the space 1030 through the supply line 1012. Similarly, the boiler 212 is capable of receiving the utilized domestic hot water from the space 1030 for supplying conditioned domestic hot water to the first portion of the space 1030. Towards the second portion 1020 of the space 1030, the boiler 218 receives the utilized conditioned fluid from the second return line 1024 for supplying conditioned fluid to the space 1030 through the supply line 1022. The boilers 210, 212, 214, 216, and 218 have a common outlet and a common inlet. Both inlets and outlets are equipped with a boiler flow control valve 250*a* and 250*b* respectively. The boiler flow control valve 250*a* is configured to receive the utilized conditioned fluid and utilized domestic hot water from the space 1030 and the boiler flow control valve 250*b* is configured to circulate conditioned fluid and the domestic hot water supply to the space 1030. The boiler flow control valves 250*a* and 250*b* can modulate from fully closed to fully open situation, thereby permitting the boilers 210, 212, 214, 216, and 218 to generate domestic hot water and space heat simultaneously. A typical domestic hot water load occurs three times daily. The morning and evening peak loads are fairly consistent. The controlling module, for instance, a Building Automation System (BAS) is equipped to use real time controls, and recognize the history of domestic hot water (DHW) use. This allows boiler water temperature to be reset higher during peak domestic hot water loads, and to minimize stand-by losses or the need to bring on an additional boiler. The controlling module will identify the heating load and the domestic hot water load from an aquastat located in the bottom ⅓ of DHW storage tanks (not shown). The building load for space heating will be determined by the outside air temperature (OSA) and indoor air temperature network, as well as solar load sensors positioned outside the building.

The domestic hot water load will always have priority over space heating load. In the event that the domestic hot water load and the space heating load cannot be met with one boiler, the controlling module will start the second boiler based on temperature of a storage tank sensor. The controlling module will determine when the space heating load will be required by set points of the OSA temperature reset schedule. Each particular building and climate will dictate this schedule. During non-heating seasons inlet cross line valves (not shown) may be shut down to avoid any flow but check valves on the space heat return or inlet lines will significantly reduce this effect. Furthermore, the controlling module will close the space heating flow control valve 250*a* and the flow will only be directed to the domestic hot water load. The boiler control valves disposed between the first return line 1014 and the inlet to the plurality of boilers 210, 212, 214, 216, and 218 control and coordinate the flow between the space heating and the domestic hot water heating. Thus the utilization of the system 1000 serves the purpose of meeting different requirements along to different portions of the space 1030 simultaneously. In one embodiment, the inputs of the plurality of boilers 210, 212, 214, 216, and 218 may vary from 300,000 Btu to over 1,500,000 Btu. The present disclosure utilizes modular design and piping of these boilers which are also fully modulating, firing 15% to 100% of input. This allows an effective matching of firing operation to the boiler load.

Figure 3:
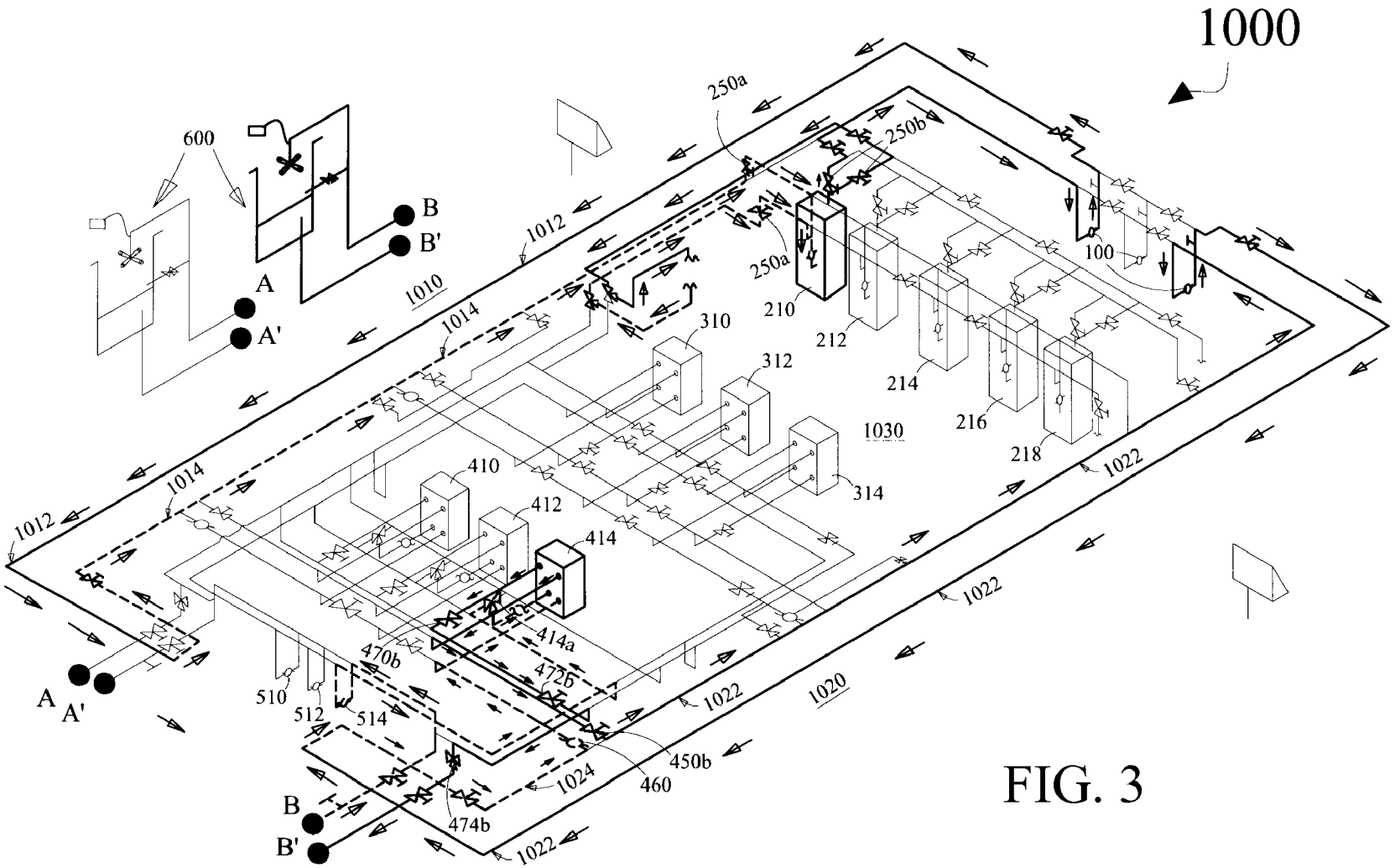
FIG. 3 is a schematic line diagram of the automatic switching two pipe hydronic system 1000, illustrating the boiler 210 heating the first portion 1010 of the space 1030 and a heat exchanger 414 cooling the second portion 1020 of the space 1030, according to another exemplary embodiment of the present disclosure.

Now, referring to FIG. 3, illustrated is a schematic line diagram of the system 1000, wherein one boiler from the plurality of boilers 210, 212, 214, 216, and 218 is heating a first portion 1010 of the space 1030 and also providing domestic heat water to the first portion 1010 and cooling a second portion using a heat exchanger 414. Upon determining the requirement of heating the first portion 1010 by the controlling module, the boiler 210 is fired and the boiler 210 receives the utilized conditioned fluid from the first return line 1014 for supplying conditioned fluid to the space 1030 through the supply line 1012. Further, the boiler 210 receives utilized domestic heat water from the space 1030 and provides conditioned domestic hot water to the space 1030. The boiler 210 has a common outlet and a common inlet. Both inlets and outlets are equipped with a boiler flow control valves 250*a* and 250*b* respectively. The boiler flow control valve 250*a* is configured to receive the utilized conditioned fluid and utilized domestic hot water from the space 1030 and the boiler flow control valve 250*b* is configured to circulate conditioned fluid and the conditioned domestic hot water supply to the space 1030. The boiler flow control valves 250*a* and 250*b* can modulate, from fully closed to fully open situation, thereby permitting the boiler 210 to generate domestic hot water and space heat simultaneously. Now, towards the second portion 1020 of the space 1030, the heat exchanger 414 receives the utilized conditioned fluid from the second return line 1024 for supplying conditioned fluid to the space 1030 through the supply line 1022. The controlling module opens a valve of a heat exchanger pump 460 disposed on an inlet cross line for permitting the use of the utilized conditioned fluid into the heat exchanger 414. Further, a heat exchanger flow control valve 450*b* is disposed on the outlet of heat exchanger 414 for controlling the flow from the heat exchanger 414. The utilized conditioned fluid from the second return line 1024 is cooled down in the heat exchanger 414 by dissipating the heat of the utilized conditioned fluid to a circulating cooling tower fluid from the cooling tower 600. The circulating cooling tower fluid from the cooling tower 600 passes through the condenser pump 514 and enters into the heat exchanger 414 via a three way valve 414*a*. The circulating cooling tower fluid carrying the heat from the heat exchanger 414 passes through a plurality of valves 470*b*, 472*b*, and 474*b* to the cooling tower 600. The conditioned fluid from the heat exchanger 414 is delivered to the supply line 1022 through the automatic flow control valve 450*b*.

Figure 4:
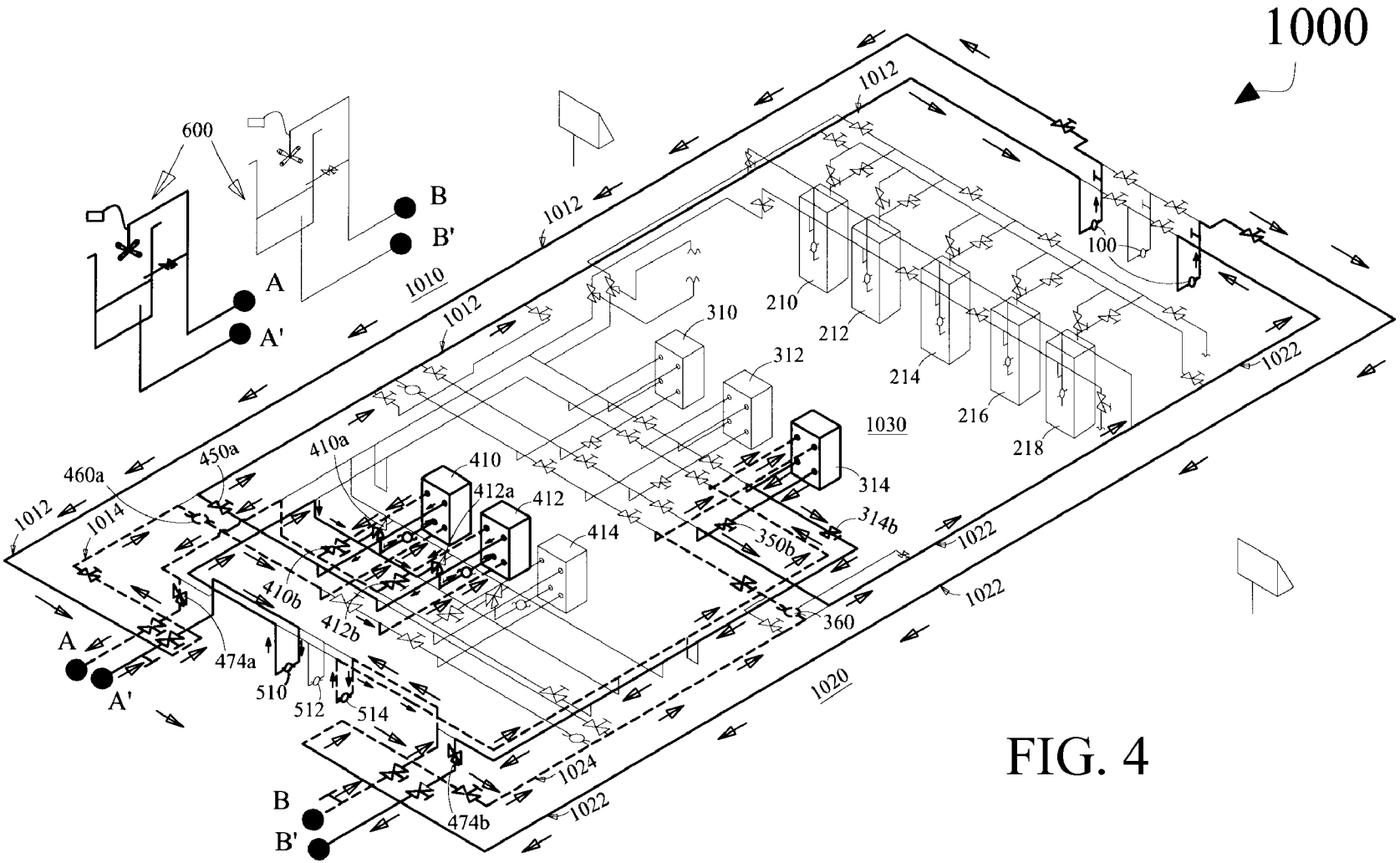
FIG. 4 is a schematic line diagram of the automatic switching two pipe hydronic system 1000, illustrating heat exchangers 410 and 412 moderately heating the first portion 1010 of the space 1030 and a chiller 314 cooling the second portion 1020 of the space 1030, according to another exemplary embodiment of the present disclosure.

FIG. 4 refers to another embodiment of the present disclosure, illustrating a schematic line diagram of the system 1000, wherein the first portion 1010 of the space 1030 needs to be moderately heated and the second portion 1020 of the space 1030 needs to be air-conditioned (i.e., cooled.) The system 1000 uses two heat exchangers 410 and 412 from the plurality of heat exchangers 410, 412, and 414 for moderately heating the first portion 1010 of the space 1030 and uses the chiller 314 from the plurality of chillers, 310, 312, and 314 for cooling the second portion 1020 of the space 1030.

Now, towards the first portion 1020 of the space 1030, the heat exchanger 410 and 412 receives the utilized conditioned fluid from the first return line 1014 for supplying conditioned fluid to the space 1030 through the first supply line 1012. The controlling module opens a valve of a heat exchanger pump 460*a* disposed on an inlet cross line for permitting the use of the utilized conditioned fluid into the heat exchangers 410 and 412. Further, a heat exchanger flow control valve 450*a* is disposed on the outlet of heat exchangers 410, 412 for controlling the flow from the heat exchangers 410, 412. The utilized conditioned fluid from the first return line 1014 is cooled down in the heat exchangers 410 and 412 by dissipating the heat of the utilized conditioned fluid to a circulating cooling tower fluid from the cooling tower 600. The circulating cooling tower fluid from the cooling tower 600 passes through the condenser pump 510 and enters into the heat exchangers 410, 412 via three way valves 410*a* and 412*a*. The circulating cooling tower fluid carrying the heat from the heat exchangers 410, 412 passes through a plurality of valves 410*b*, 474*a* of the heat exchanger 410 and through valves 412*b*, 474*a* of heat exchanger 412, to the cooling tower 600. The conditioned fluid from the heat exchanger 410 and 412 is delivered to the supply line 1012 through the automatic flow control valve 450*a*.

Now towards the second portion 1020 of the space 1030, the chiller 314 receives the utilized conditioned fluid from the second return line 1024 for supplying conditioned fluid to the space 1030 through the second supply line 1022. The controlling module opens a valve of a chiller pump 360 disposed on an inlet cross line for permitting the use of the utilized conditioned fluid into the chiller 314. Further, a heat exchanger flow control valve 350*b* is disposed on the outlet of the chiller 314 for controlling the flow from the chiller 314. The utilized conditioned fluid from the second return line 1024 is cooled down in the chiller 314 by dissipating the heat of the utilized conditioned fluid to a circulating cooling tower fluid from the cooling tower 600. The circulating cooling tower fluid from the cooling tower 600 passes through the condenser pump 514 and enters into the chiller 314. The circulating cooling tower fluid carrying the heat from the chiller 314 passes through a plurality of valves 314*b*, and 474*b* to the cooling tower 600. The conditioned fluid from the chiller 314 is delivered to the supply line 1022 through the automatic flow control valve 350*b*.

Figure 5:
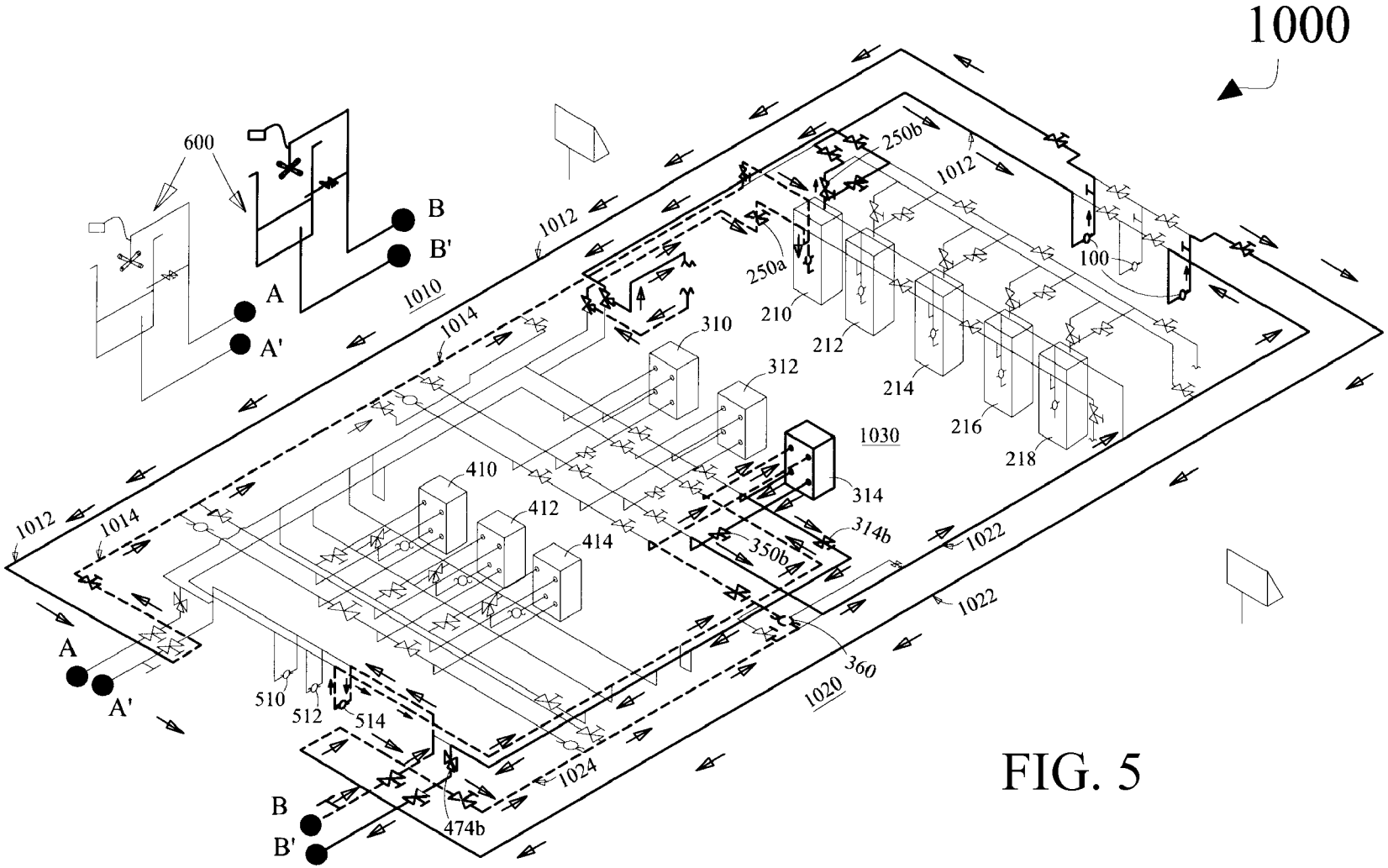
FIG. 5 is a schematic line diagram of the automatic switching two pipe hydronic system 1000, illustrating the boiler 210 heating the first portion 1010 of the space 1030 and the chiller 314 cooling the second portion 1020 of the space 1030, according to another exemplary embodiment of the present disclosure.

Now, referring to FIG. 5, illustrated is a schematic line diagram of the system 1000, wherein one boiler from the plurality of boilers 210, 212, 214, 216, and 218 is heating a first portion 1010 of the space 1030 and also providing domestic heat water to the first portion 1010 and cooling a second portion using a chiller 314. Upon determining the requirement of heating the first portion 1010 by the controlling module, the boiler 210 is fired and the boiler 210 receives the utilized conditioned fluid from the first return line 1014 for supplying conditioned fluid to the space 1030 through the supply line 1012. Further, the boiler 210 receives utilized domestic heat water from the space 1030 and provides conditioned domestic hot water to the space 1030. The boiler 210 has a common outlet and a common inlet. Both inlets and outlets are equipped with a boiler flow control valves 250*a* and 250*b* respectively. The boiler flow control valves 250*a* is configured to receive the utilized conditioned fluid and utilized domestic hot water from the space 1030 and the boiler flow control valves 250*b* is configured to circulate conditioned fluid and the conditioned domestic hot water supply to the space 1030. The boiler flow control valves 250*a* and 250*b* can modulate, from fully closed to fully open situation, thereby permitting the boiler 210 to generate domestic hot water and space heat simultaneously.

Now towards the second portion 1020 of the space 1030, the chiller 314 receives the utilized conditioned fluid from the second return line 1024 for supplying conditioned fluid to the space 1030 through the second supply line 1022. The controlling module opens a valve of a chiller pump 360 disposed on an inlet cross line for permitting the use of the utilized conditioned fluid into the chiller 314. Further, a chiller flow control valve 350*b* is disposed on the outlet of the chiller 314 for controlling the flow from the chiller 314. The utilized conditioned fluid from the second return line 1024 is cooled down in the chiller 314 by dissipating the heat of the utilized conditioned fluid to a circulating cooling tower fluid from the cooling tower 600. The circulating cooling tower fluid from the cooling tower 600 passes through the condenser pump 514 and enters into the chiller 314. The circulating cooling tower fluid carrying the heat from the chiller 314 passes through a plurality of valves 314*b*, and 474*b* to the cooling tower 600. The conditioned fluid from the chiller 314 is delivered to the supply line 1022 through the automatic flow control valve 350*b*.

Figure 6:
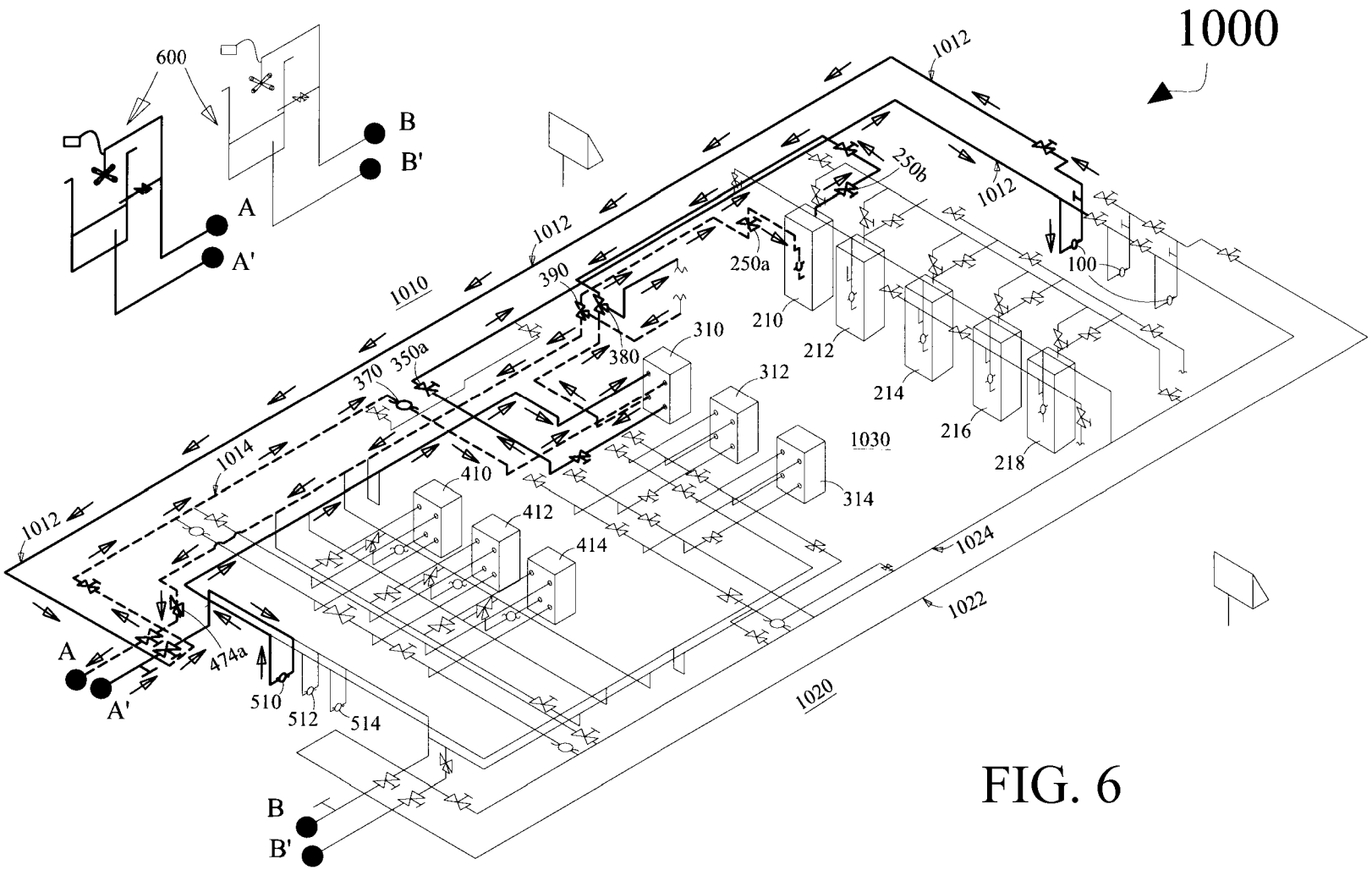
FIG. 6 is a schematic line diagram of the automatic switching two pipe hydronic system 1000 illustrating the need for cooling the first portion 1010 and providing domestic hot water by utilizing the rejected heat of the chiller 310, according to another exemplary embodiment of the present disclosure.

FIG. 6 is a schematic line diagram of the system 1000 illustrating the need for cooling the first portion 1010 and providing domestic hot water by utilizing the rejected heat of the chiller 310. In this embodiment, upon detection by the controlling module, the requirement of cooling the first portion 1010 of the space 1030, the controlling module opens a valve of the chiller pump 370 disposed on an inlet cross line for permitting the use of the utilized conditioned fluid into the chiller 310. Further, a chiller flow control valve 350*a* is disposed on the outlet of the chiller 310 for controlling the flow from the chiller 310. The utilized conditioned fluid from the first return line 1014 is cooled down in the chiller 310 by dissipating the heat of the utilized conditioned fluid to a circulating cooling tower fluid from the cooling tower 600. The conditioned fluid from the chiller 310 is supplied to the supply line 1012 through the chiller flow control valve 350*a* and the closed loop pump 100 to the first portion 1010. The circulating cooling tower fluid from the cooling tower 600 passes through the condenser pump 510 and enters into the chiller 310. The circulating cooling tower fluid carrying the heat from the chiller 310 passes through a domestic hot water heat exchanger three way valve 380 and may be supplied as domestic hot water supply. The conditioned fluid from the boiler 210 is delivered as domestic hot water through the domestic hot water heat exchanger three way valve 380. The utilized domestic hot water from the first portion 1010 is delivered as to the cooling tower 600 through the domestic hot water heat exchanger three way valve 390. Furthermore, the utilized domestic hot water from the first portion 1010 is delivered as supply to the boiler 210 through the domestic hot water heat exchanger three way valve 390. Thereby the system 1000 enables utilization of the rejected heat of the chiller 310 to be utilized for the boiler 210 as well as to domestic hot water supply.

The foregoing descriptions of specific embodiments of the present disclosure have been presented for purposes of illustration and description. They are not intended to be exhaustive or to limit the disclosure to the precise forms disclosed, and obviously many modifications and variations are possible in light of the above teaching. The embodiments were chosen and described in order to best explain the principles of the disclosure and its practical application, and to thereby enable others skilled in the art to best utilize the disclosure and various embodiments with various modifications as are suited to the particular use contemplated. It is understood that various omissions, substitutions, and equivalents are contemplated as circumstances may suggest or render expedient, but it is intended to cover the application or implementation without departing from the spirit or scope of the claims of the present disclosure.

What is claimed is:

1. A system for simultaneously heating and cooling a first portion and a second portion of a space, the system comprising:

a first flow path disposed towards the first portion, the first flow path having a first supply line and a first return line;

a second flow path disposed towards the second portion, the second flow path having a second supply line and a second return line wherein the supply line configured to supply a conditioned fluid to the space and the return line configured to return utilized conditioned fluid from the space, a plurality of closed loop pumps capable of circulating the conditioned fluid and the utilized conditioned fluid between the supply and return lines of the first flow path and the second flow path;

a plurality of boilers disposed between the first portion and the second portion, the boilers capable of providing conditioned fluid to the first supply line and the second supply line;

a plurality of heat exchangers disposed between the first portion and the second portion, the heat exchangers capable of receiving utilized conditioned fluid from the first and the second return line, for reducing the temperature of the utilized conditioned fluid in the first return line and the second return line to be supplied as the conditioned fluid to the first supply line and the second supply line by transferring heat of the utilized conditioned fluid to a cooling tower fluid;

a plurality of chillers disposed between the first portion and the second portion, the chillers capable of receiving utilized conditioned fluid from the first return line and the second return line, for reducing the temperature of the utilized conditioned fluid in the first return line and the second return line to be supplied as the conditioned fluid to the first supply line and the second supply line by transferring heat of the utilized conditioned fluid to the cooling tower fluid;

a plurality of condenser pumps disposed between the first flow path and the second flow path, the condenser pumps capable of circulating a cooling tower fluid between the cooling tower and the plurality of heat exchangers and the plurality of chillers;

a plurality of boiler flow control valves coupled to the plurality of boilers, the boiler flow control valves capable of controlling the flow of utilized conditioned fluid to the boilers from the first and second return lines and conditioned fluid from the boiler to the first and second supply lines;

a plurality of chiller flow control valves coupled to the plurality of chillers, the chiller flow control valves capable of controlling the flow of utilized conditioned fluid to the chillers from the first and second return lines and conditioned fluid from the chillers to the first and second supply lines;

a plurality of heat exchanger flow control valves coupled to the plurality of heat exchangers, the heat exchanger flow control valves capable of controlling the flow of utilized conditioned fluid to the heat exchangers from the first and second return lines and conditioned fluid from the heat exchangers to the first and second supply lines;

a plurality of sensors for sensing an outside space temperature, a temperature of the first portion and the second portion inside the space, and temperatures of the conditioned fluid and the utilized conditioned fluid in the first flow path and the second flow path; and a controlling module configured to acquire temperatures from the plurality of sensors and capable of controlling the flow of conditioned fluid and utilized conditioned fluid through the boiler, chiller and heat exchanger flow control valves, wherein the controlling module is configured to operate the boiler, the chiller and the heat exchanger flow control valves in a manner such that at least one boiler from the plurality of boilers and at least one chiller from the plurality of chillers or at least one heat exchanger from the plurality of heat exchangers are capable of heating or cooling the first portion and the second portion simultaneously.

2. The system of claim 1, wherein the plurality of boilers are further capable receiving utilized domestic hot water through a domestic hot water heat exchanger and producing conditioned domestic hot water.

3. The system of claim 1, wherein at least one inlet boiler flow control valve is disposed on an inlet to the plurality of boilers for receiving the utilized conditioned fluid and utilized domestic hot water from the space.

4. The system of claim 1, wherein at least one outlet boiler flow control valve is disposed on an outlet to the plurality of boilers for circulating the conditioned fluid and conditioned domestic hot water to the space.

5. The system of claim 1, wherein the system is capable of heating the first portion of the space by using a first boiler from the plurality of boilers and cooling the second portion by using a first heat exchanger from the plurality of heat exchangers.

6. The system of claim 5, wherein the utilized conditioned fluid from the first return line is received by the first boiler and heated therein to be supplied to the first portion through the first supply line and the utilized conditioned fluid from the second return line is received by the heat exchanger and cooled therein to be supplied to the second portion through the second supply line.

7. The system of claim 1, wherein the system is capable of moderately heating the first portion of the space by using at least one heat exchanger and cooling the second portion by using a first chiller from the plurality of chillers.

8. The system of claim 7, wherein the utilized conditioned fluid from the first return line is received by a first heat exchanger and a second heat exchanger and moderately heated therein to be supplied to the first portion through the first supply line and the utilized conditioned fluid from the second return line is received by the chiller and cooled therein to be supplied to the second portion through the second supply line.

9. The system of claim 1, wherein the system is capable of heating the first portion of the space by using a first boiler from the plurality of boilers and cooling the second portion by using a first chiller from the plurality of chillers.

10. The system of claim 9, wherein the utilized conditioned fluid from the first return line is received by the first boiler and heated therein to be supplied to the first portion through the first supply line and the utilized conditioned fluid from the second return line is received by the chiller and cooled therein to be supplied to the second portion through the second supply line.

11. The system of claim 1, wherein the system is further capable of utilizing the rejected heat of the chiller for supplying as domestic hot water.

12. The system of claim 11, wherein the utilized conditioned fluid from the first return line is cooled in the chiller using a circulating cooling tower fluid, in a manner, such that, the circulating cooling tower fluid carrying the rejected heat from the utilized conditioned fluid in the chiller is utilized as domestic hot water supply.

* * * * *